US007228965B2

(12) United States Patent
Marventano et al.

(10) Patent No.: US 7,228,965 B2
(45) Date of Patent: Jun. 12, 2007

(54) INTEGRATED APPLIANCE CONTAINER FOR SUPPORT DURING ASSEMBLY TRANSPORT AND DISPLAY

(75) Inventors: James Robert Marventano, Atlanta, GA (US); Todd J. Demerit, Minneapolis, MN (US); John VanDerKolk, Milan, MI (US)

(73) Assignee: International Paper Company, Memphis, TN (US)

( * ) Notice: Subject to any disclaimer, the term of this patent is extended or adjusted under 35 U.S.C. 154(b) by 434 days.

(21) Appl. No.: 10/952,588

(22) Filed: Sep. 25, 2004

(65) Prior Publication Data

US 2006/0065561 A1 Mar. 30, 2006

(51) Int. Cl.
*B65D 85/00* (2006.01)

(52) U.S. Cl. ..... 206/320; 206/497

(58) Field of Classification Search ..... 206/320, 206/521, 386, 597, 497; 220/6, 4.28, 4.33
See application file for complete search history.

(56) References Cited

U.S. PATENT DOCUMENTS

| | | | | |
|---|---|---|---|---|
| 4,811,840 | A * | 3/1989 | Muyskens | 206/320 |
| 4,881,840 | A | 11/1989 | Rendon et al. | |
| 5,131,541 | A * | 7/1992 | Liebel | 206/453 |
| 5,161,692 | A * | 11/1992 | Knierim | 206/586 |
| 6,357,587 | B1 * | 3/2002 | Melms, Jr. | 206/326 |
| 6,578,346 | B1 | 6/2003 | Sowa | |

* cited by examiner

*Primary Examiner*—Shian T. Luong
(74) *Attorney, Agent, or Firm*—Thomas W. Barnes, III; Daniel C. Stelter; Kenneth R. Schaefer

(57) ABSTRACT

An appliance packaging assembly and method wherein a reinforced base pad is disposed under an appliance, a plurality of rigid posts are disposed between the base pad and alongside the appliance, a transparent film is disposed about the posts and the appliance, a reinforced cover having a lifting flange member on a side portion thereof, the cover disposed over the plurality of wrapped posts and appliance.

7 Claims, 11 Drawing Sheets

INTEGRATED APPLIANCE CONTAINER FOR SUPPORT DURING ASSEMBLY TRANSPORT AND DISPLAY

BACKGROUND OF THE INVENTION

This invention relates generally to packaging assemblies, and more particularly to strong, protective but at least partially transparent appliance packaging assemblies and methods for producing such assemblies.

Presently, many appliances such as refrigerators, ranges, dishwashers and laundry machines, including washers and dryers, are packaged in full corrugated boxes after manufacture for shipping and handling. A discussion of such boxes is provided, for example, in U.S. Pat. No. 6,578,346, granted Jun. 17, 2003.

Fully corrugated packages have many advantages including relatively good protection of the appliance, durability and high reliability. Many of these packages may also be lifted and handled by a "Basiloid" spade or blade mounted on a lift truck. The Basiloid blade is a generally u-shaped member that is hooked under interlocking folded flaps of a top cap on a side portion of the package or container, and permits handling of the container without clamping or fork lifting. The Basiloid blade is used widely in the United States.

Although fully corrugated packages have many advantages these packages prevent viewing or inspection of the contents of the package without opening the closed package. Visual inspection is highly desirable for assessing shipping damage, for identifying product and for ultimate display in a retail or warehouse environment. Fully corrugated packages are also sometimes difficult to assemble, result in a significant amount of material to be recycled and are relatively costly.

As an alternative, transparent film type packaging has been developed for appliances in an effort to reduce materials, labor and costs. U.S. Pat. No. 4,881,840 entitled "Appliance Shipping Container with Integral Corner Post", for example, discloses a corrugated container wrapped with a transparent film. That type container includes corrugated side panels with cutout windows on opposing sides of the container. The side panels also have overlapping folded portions that are retained over the upper portion of the appliance by a horizontal strap.

Transparent appliance packaging allows the contents to be inspected visually. However, transparent appliance packaging has not been accepted widely because of an inability to be applied for heavier packaging applications.

The present invention is directed to improvements in packaging assemblies, and more particularly to transparent packaging assemblies in which at least a portion of the assembly could be could be used to support the appliance on the assembly line and, as the appliance itself is assembled, the packaging assembly can be completed around the appliance in a simple, effective and low cost manner.

An advantage of the invention is that it provides novel, desirable packaging assemblies for appliances or the like which can be lifted and handled by a Basiloid blade.

A further advantage of the invention is that it provides novel packaging assemblies and methods useable for appliances comprising generally a reinforced base pad disposed beneath an appliance to be packaged and a plurality of posts disposed alongside the appliance and extending between the base pad and a top cover. The base pad is configured so as to be adhered to the corner posts as they are added to the package. To achieve this desired end, the base pad is provided with extended flanges that fold upwards, preferably flush with the edges of the corner posts. The flanges and posts can be sealed inline, with traditional gluing equipment or by hand labor such as staples or glue guns. A transparent film may be disposed about the posts and the appliance. The top cover includes a lifting flange member and is disposed over the plurality of posts.

Another advantage of the invention is to provide novel packaging assemblies and methods for appliances comprising a corrugated paperboard cover having folded side portions, and a lifting flange disposed across one of the cover, side or rear portions. The lifting flange member may have a reinforcing member extending from an inner portion of the cover.

These and other features and advantages of the present invention will become apparent from a consideration of the following detailed description in conjunction with the accompanying Drawings, wherein corresponding structures are referenced by corresponding reference numbers.

DETAILED DESCRIPTION OF THE INVENTION

Figures 1, 2:
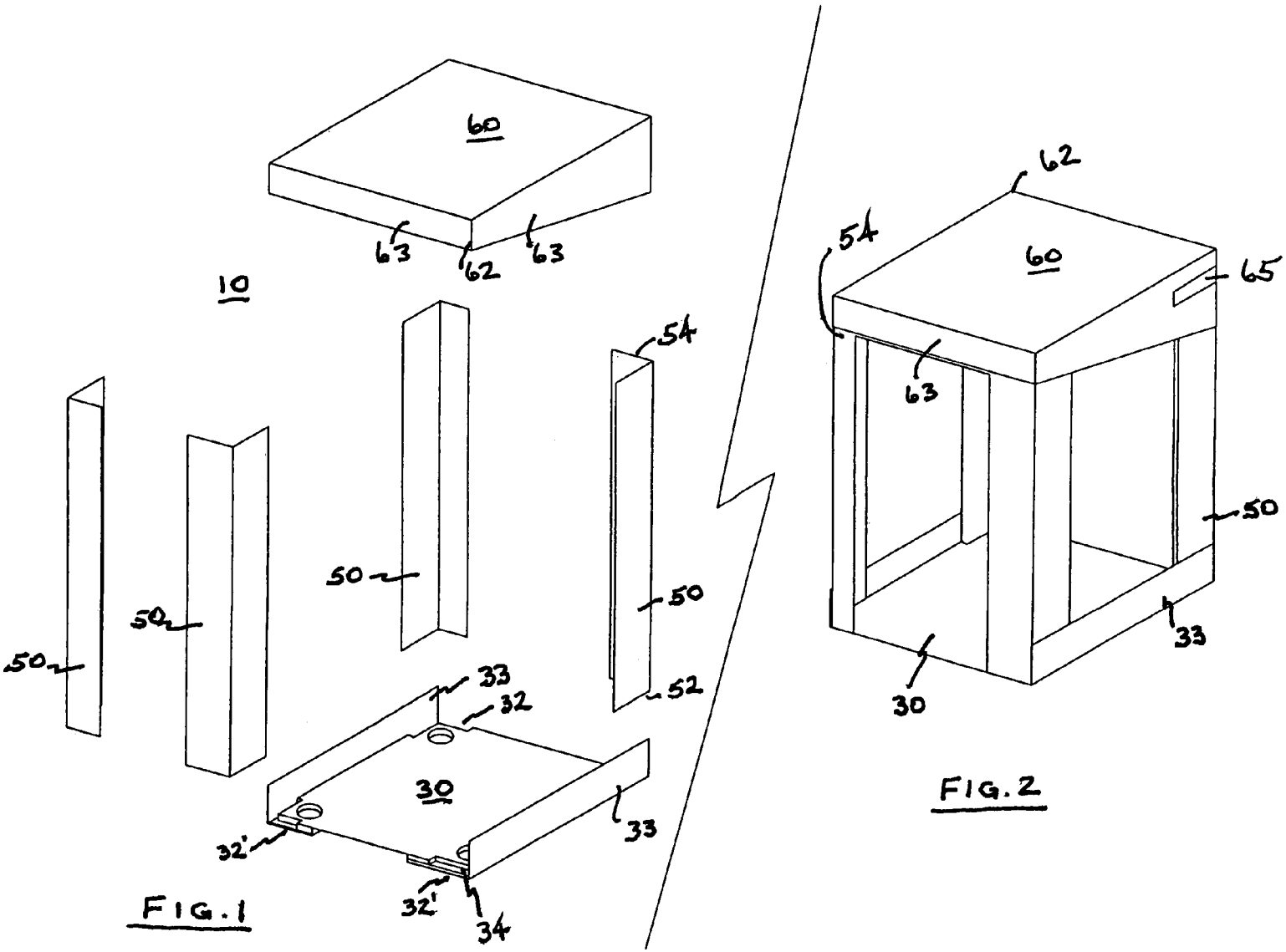
FIG. 1 is a partially exploded diagrammatic view of a packaging assembly according to an exemplary embodiment of the invention.
FIG. 2 is partial diagrammatic view of the package assembly according to the embodiment of FIG. 1.

FIG. 1 is a partial exploded view of a first packaging assembly 10 useable for packaging an appliance (not shown), which in the exemplary embodiment would be a washer or dryer. More generally, however, the packaging assembly 10 and the packaging methods of the present invention are suitable for packaging most appliances. The packaging assembly of the present invention may also be used for packaging other articles besides appliances.

Figure 11:
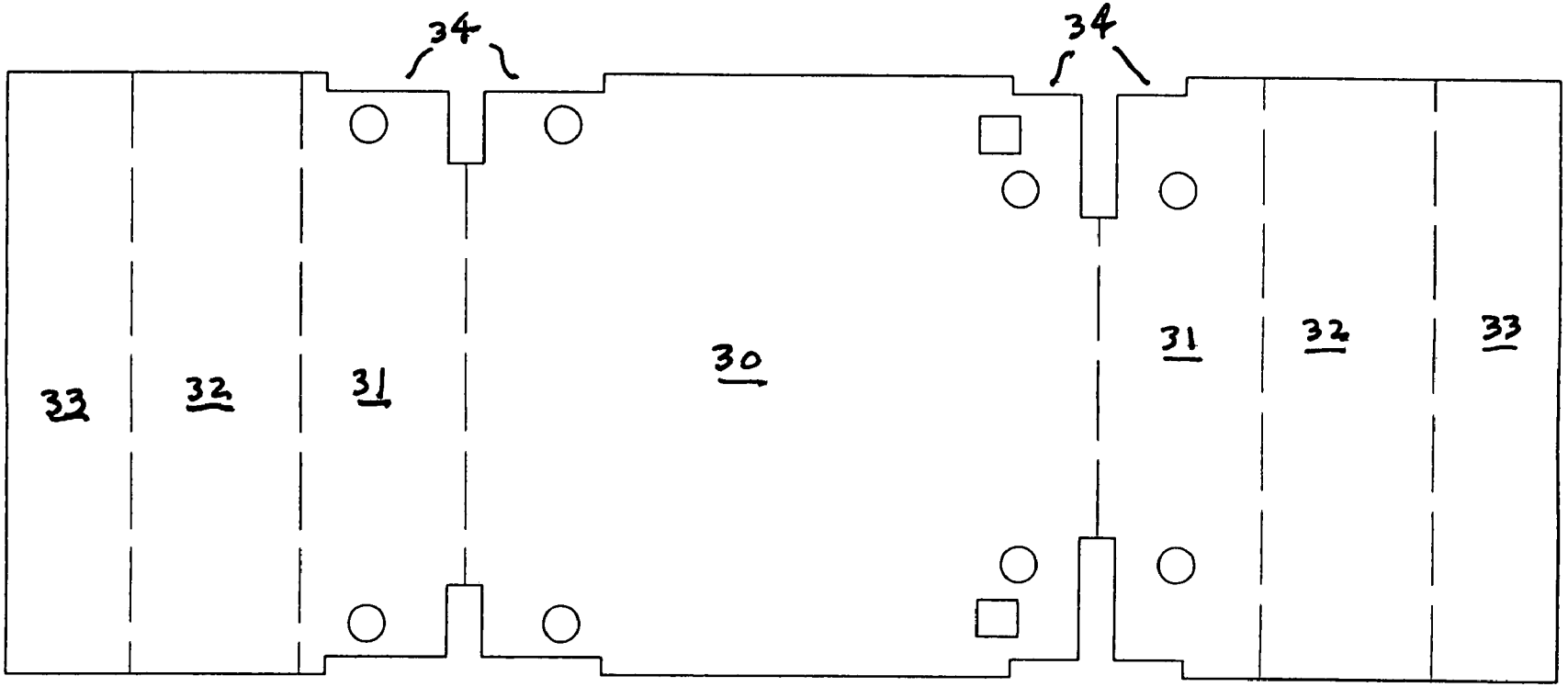
Figure 12:
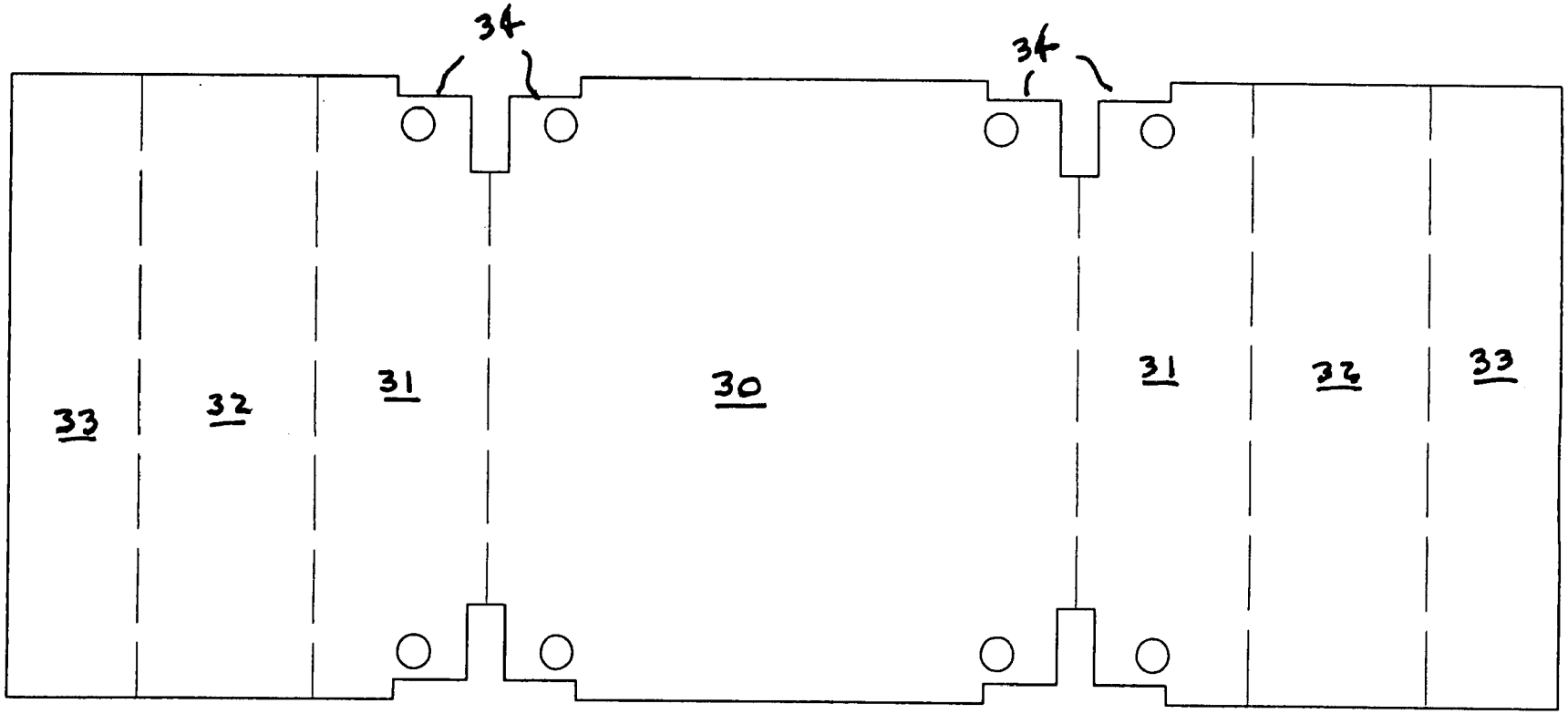
Figure 13:
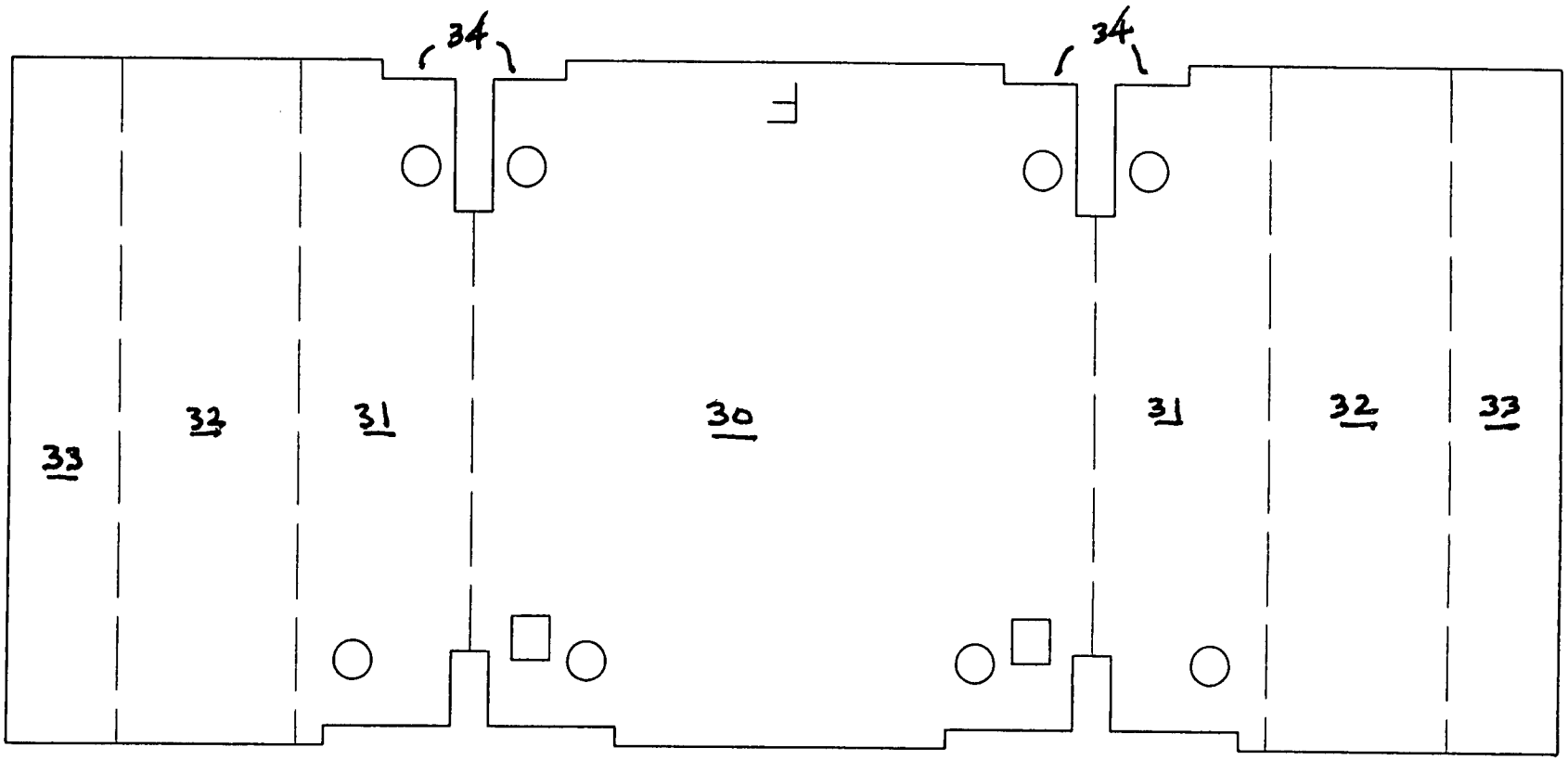

The packaging assembly 10 comprises generally a base pad 30 having upwardly extending side flange portions 33, the base pad being disposed under the appliance to be packaged as that appliance is assembled on an assembly line (not shown). The side flange portions 33 of the base pad 30 are sufficiently high to support corner posts 50 (typically four posts) during assembly of the package 10 as discussed further below. Side flange portions 33 preferably have a relatively low profile to avoid unnecessary visual obstruction of the packaged appliance. In the exemplary embodiment, the base pad 30 is generally rectangular shaped and has a plurality of corners 32' defined by the side flange portions 33 and cutaway segments 34 in the corners of each of the base pad 30 and a proximate support member flap 31 connected to base pad 30 (see FIGS. 11–13).

Figure 3:
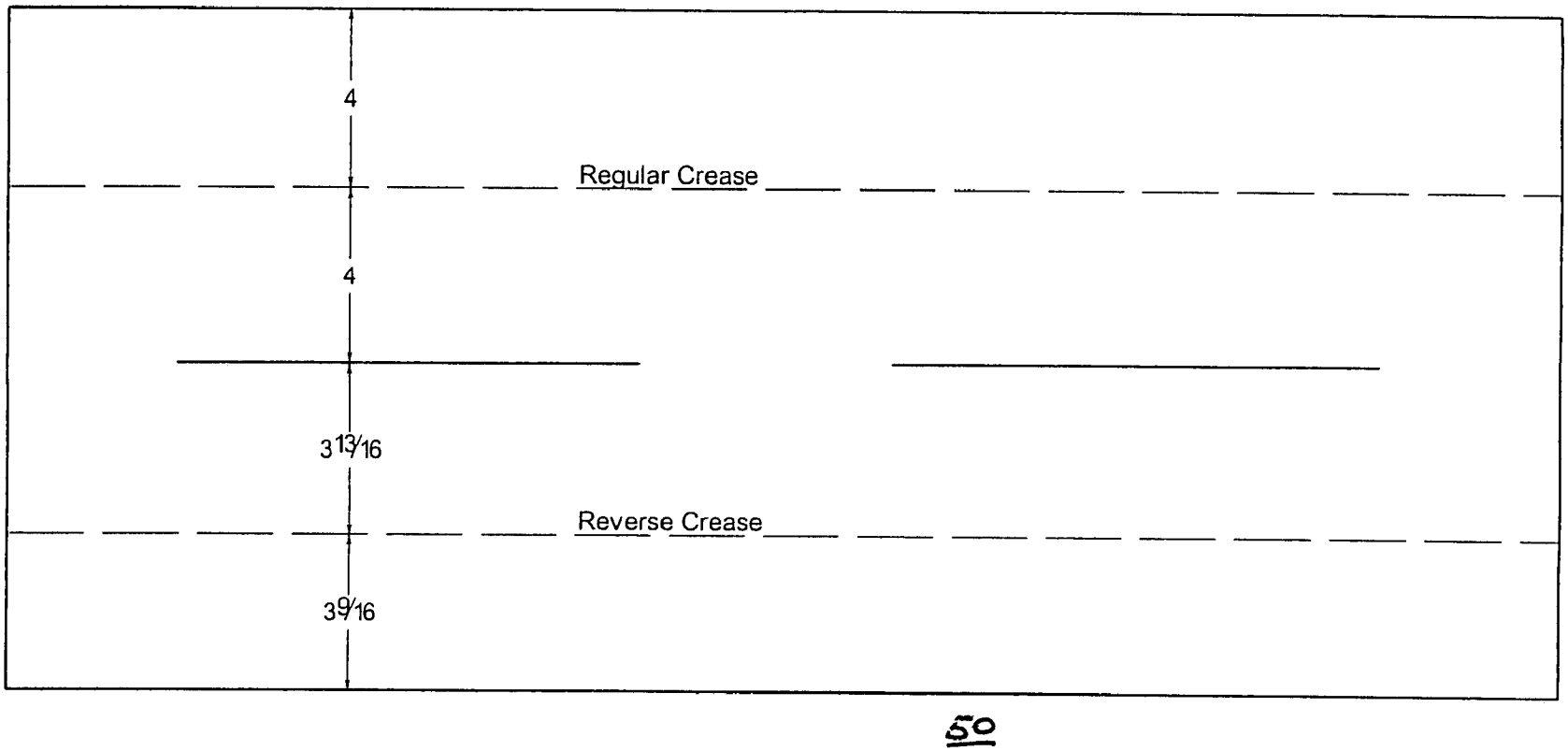
FIG. 3 is a layout of a first corner post for use in connection with one embodiment of the present invention.
Figure 4:
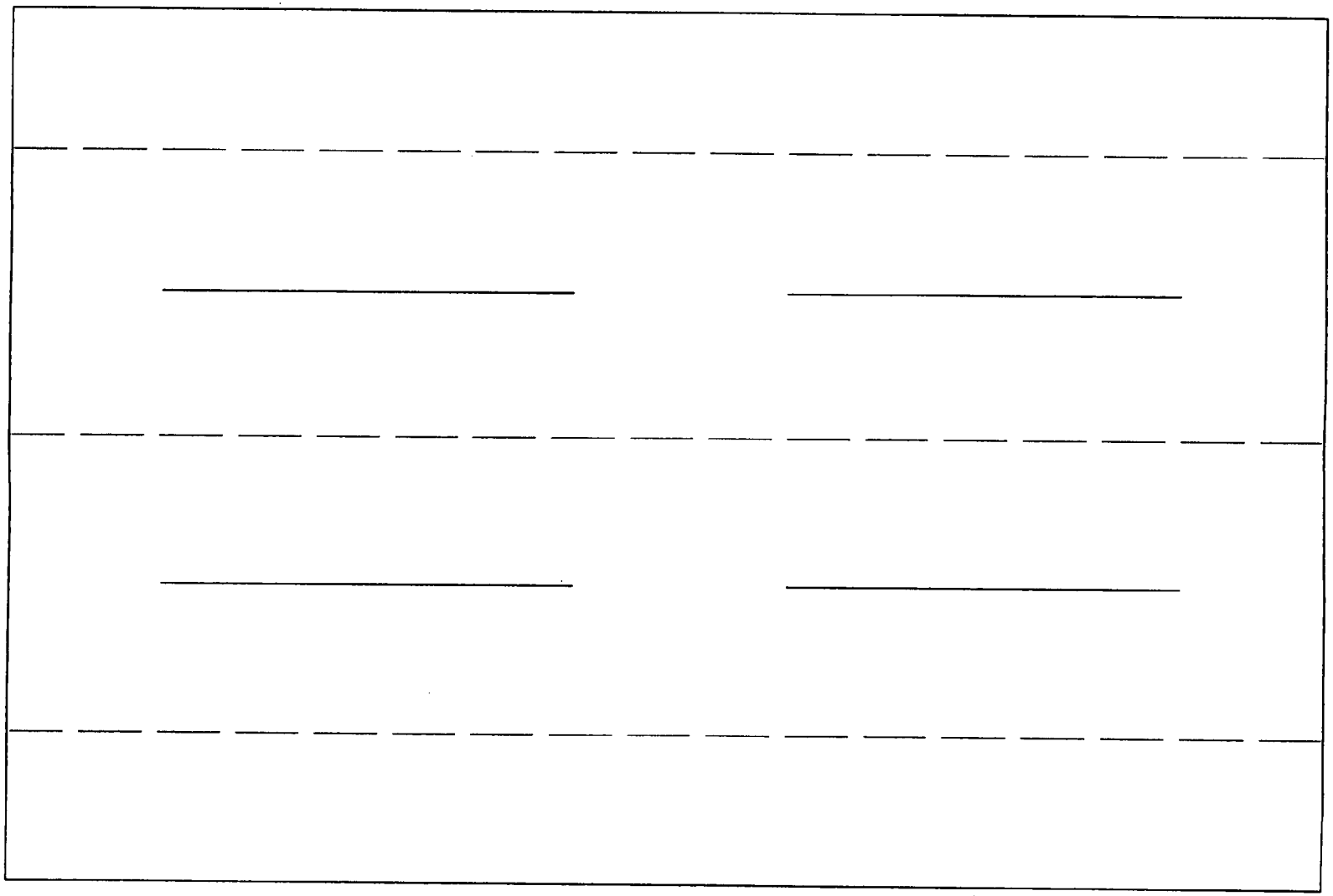
FIG. 4 is a layout of a second corner post for use in connection with an alternative embodiment of this invention.
Figure 5:
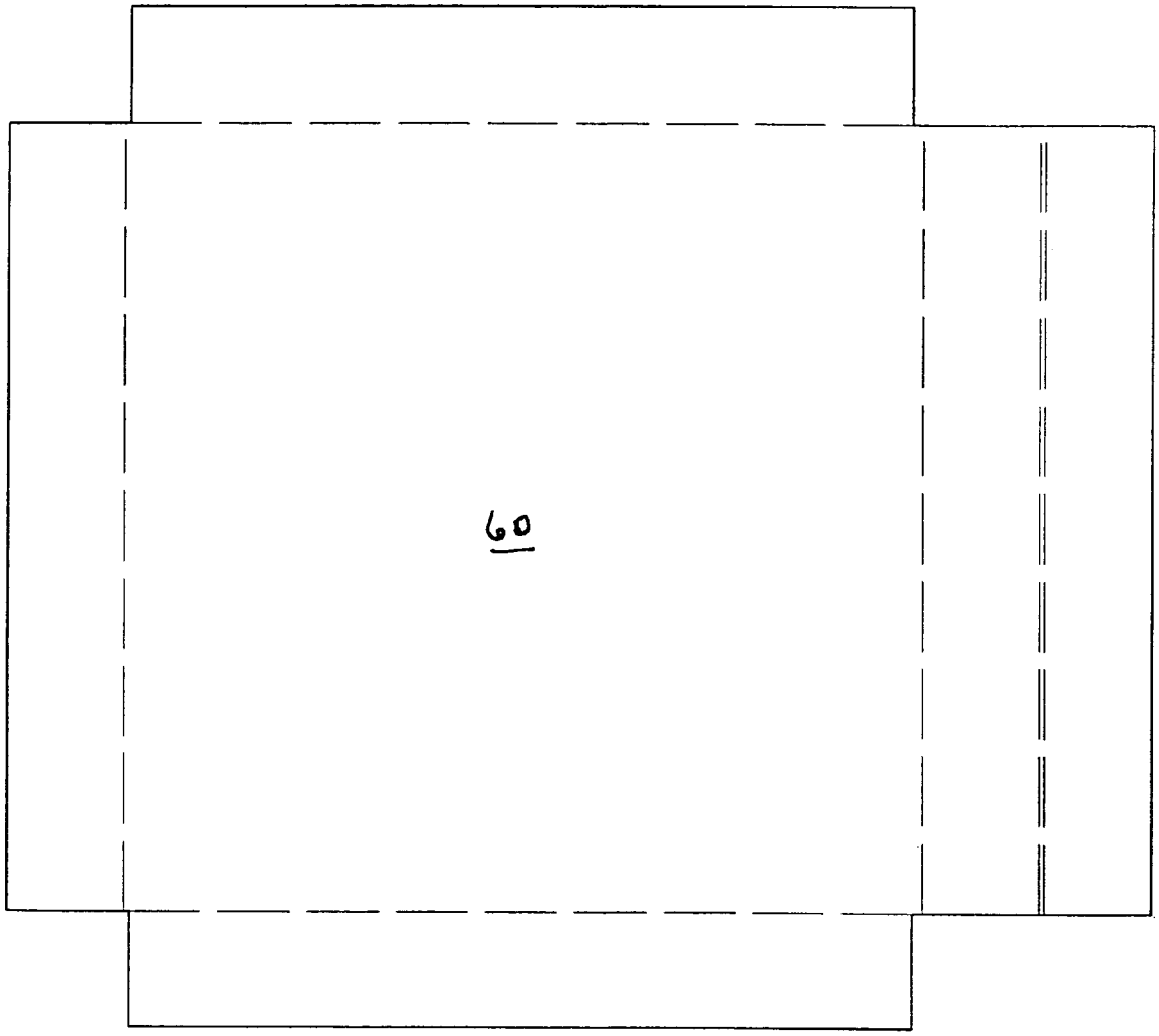
FIG. 5 is a layout of one type of top cover for use in connection with this invention.

The base pad 30 is formed preferably of a relatively low cost material, for example corrugated paperboard material, although other non-corrugated and non-paperboard materials such as honeycomb board and/or foam may be used alternatively. In the exemplary embodiment, the base pad 30, the extended flange side portions 33 and proximate and distal load bearing support members 31, 32 (see FIG. 3) are formed by folding a sheet of corrugated paperboard stock and fastening flap portions thereof with an adhesive or staples or interlocking flanges or other known means, including combinations of these elements.

The base pad 30 preferably is reinforced with two or more load bearing members 31, 32 which that extend from each side of base pad 30 prior to folding. Members 31, 32 form "runners" when folded. They add cushioning for the appliance and reinforce the base pad against warping. They also assist in allowing the packaged appliance to travel over conveyor rollers and create a void beneath the package for fork truck access when needed. In one embodiment, each of the proximate load bearing members 31 and the corners of the base pad 30 have matching holes for engagement with the underside of the appliance when the corrugated blank is appropriately folded.

Alternatively, the load bearing members are not fastened to the appliance and instead the appliance is merely positioned on the load bearing members which were previously fastened to the base pad 30 which is later secured by a transparent film to the appliance.

The packaging assembly 10 also comprises a plurality of rigid posts 50 each having a first end portion 52 and an opposing second end portion 54. The rigid posts are preferably fabricated from a relatively low cost, high strength material such as corrugated paperboard material. In the exemplary embodiment, the rigid posts 50 are angled corner posts having right angle sectional shapes for strength and in some applications to enclose the appliance when assembled with the package 10.

The posts 50 may be laminated fiberboard material as is known. The strength provided by these posts permits sizing or configuring the posts 50 with a relatively low profile to provide substantial product visibility, and at the same time provide a strong package suitable for appliances.

After the base pad 30 is placed in position on line, where it will be below the appliance to be packaged, and in some applications is fastened thereto, first end portions 52 of the posts 50 are disposed generally between the side portions 33 of the base pad 30 and the cutaway segments 34 of the base pad 30 and proximal support member 31. In the exemplary embodiment, the angled corner posts 50 are disposed in corresponding corners of the base pad 30 so that the posts 50 are supported at least temporarily in a generally upright position against the corners of an appliance which has been erected on base pad 30. Before inserting the posts 50, the end portions 52 thereof which fit into the cutaway segments 34, and, more significantly, the faces of end portions 52 and/or side portions 33 which will contact each other are coated with a suitable adhesive. Posts 50 will therefore be in upright positions at the corners of the appliance which is to be (at least partially) enclosed for shipping, handling and display. Thereafter, a cover 60 is affixed to the opposite ends 54 of posts 50 by suitable means. Finally, in a preferred arrangement, a transparent film is applied around the posts 50 to enclose the appliance in a known manner.

A transparent wrapping or film may be disposed tightly about at least the posts 50 and the appliance after assembly of the posts 50 in the base pad 30 as discussed above and illustrated in FIG. 2. The transparent film is also disposed preferably over the cover 60 on the upper portion of the container for the appliance and about the side portions 33 of the base pad 30. The transparent film retains the posts 50 firmly about the appliance, and retains the base pad 30 coupled to the posts 50 if the base pad 30 is not fastened directly to the bottom portion of the appliance. The low profile posts 50 in combination with the tightly wrapped transparent film provide excellent packaging strength and improved product visibility.

The transparent film preferably is a heat shrinkable bag disposed over and covering the upper and side portions of the appliance and posts 50, and preferably over the side portions 33 of the base pad 30. The heat shrinkable bag is then shrunk tightly about the entire package upon application of heat. Heat srinkable bags suitable for this purpose are known generally and are widely available commercially. The application of the heat shrinkable bag may be performed relatively quickly with minimum labor.

The transparent material may be alternatively a stretch film applied about the posts 50, the appliance and preferably the base pad 30. Stretch films may be applied manually or by automated machinery, for example with a spiral or other wrapping machine.

FIG. 2 also illustrates the packaging assembly 10 comprising a cover 60 disposed over the appliance and over second end portions 54 of the posts 50. The cover 60 generally has the same plan view shape as the base pad 30, and in the exemplary embodiment the cover 60 is rectangular shaped in plan view with a plurality of corners 62 defined by corresponding side portions 63 thereof. The cover 60 is formed preferably of the same materials discussed above in connection with the base pad 30. However, there are additional structural and geometric features which may be incorporated in the cover 60 which will be described further (see particularly, FIGS. 9 and 10).

Figures 6, 7:
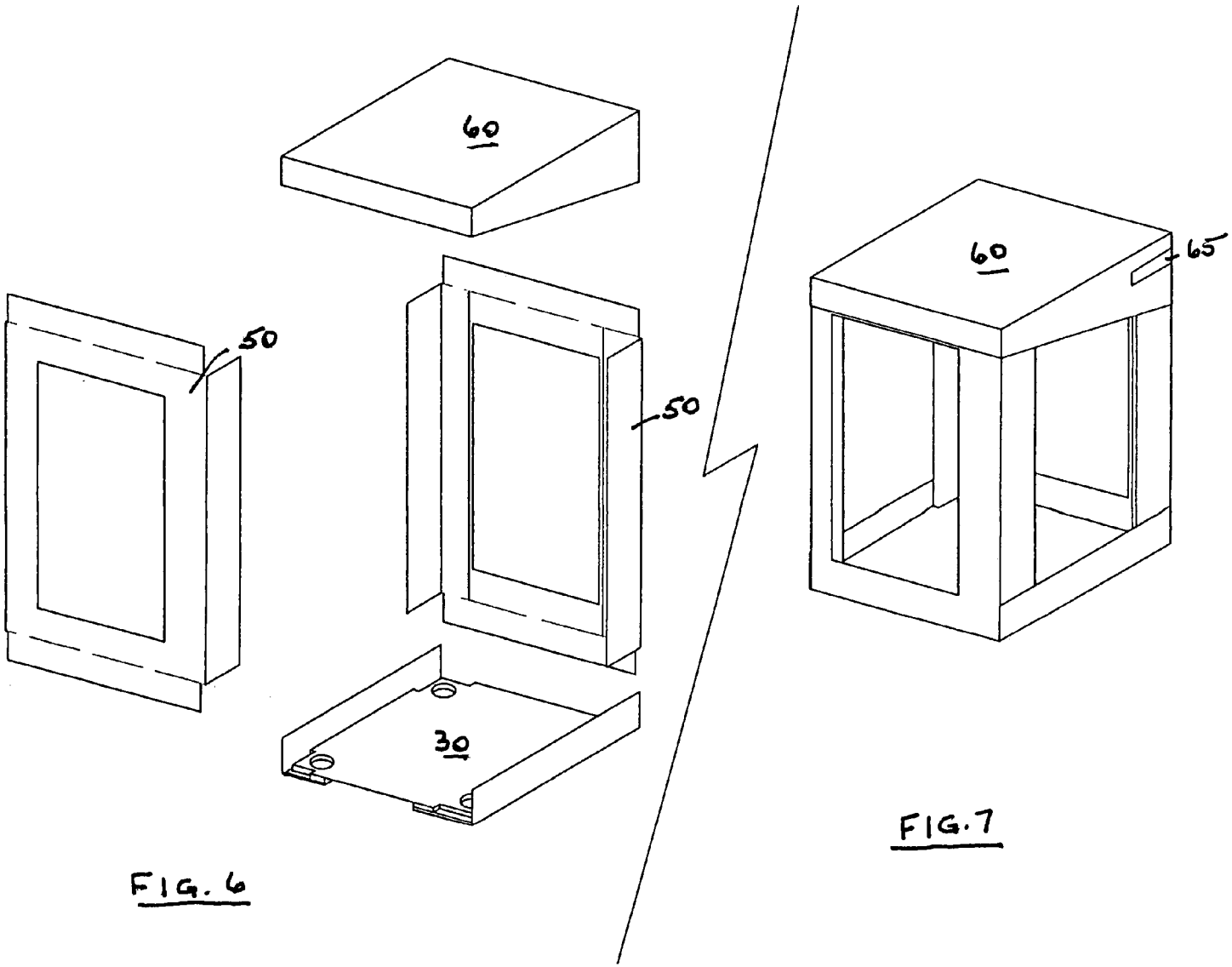
FIG. 6 is a partially exploded diagrammatic view of a packaging assembly according to a second embodiment of the present invention.
FIG. 7 is a partial diagrammatic view of the package assembly illustrated in FIG. 6.
Figure 8:
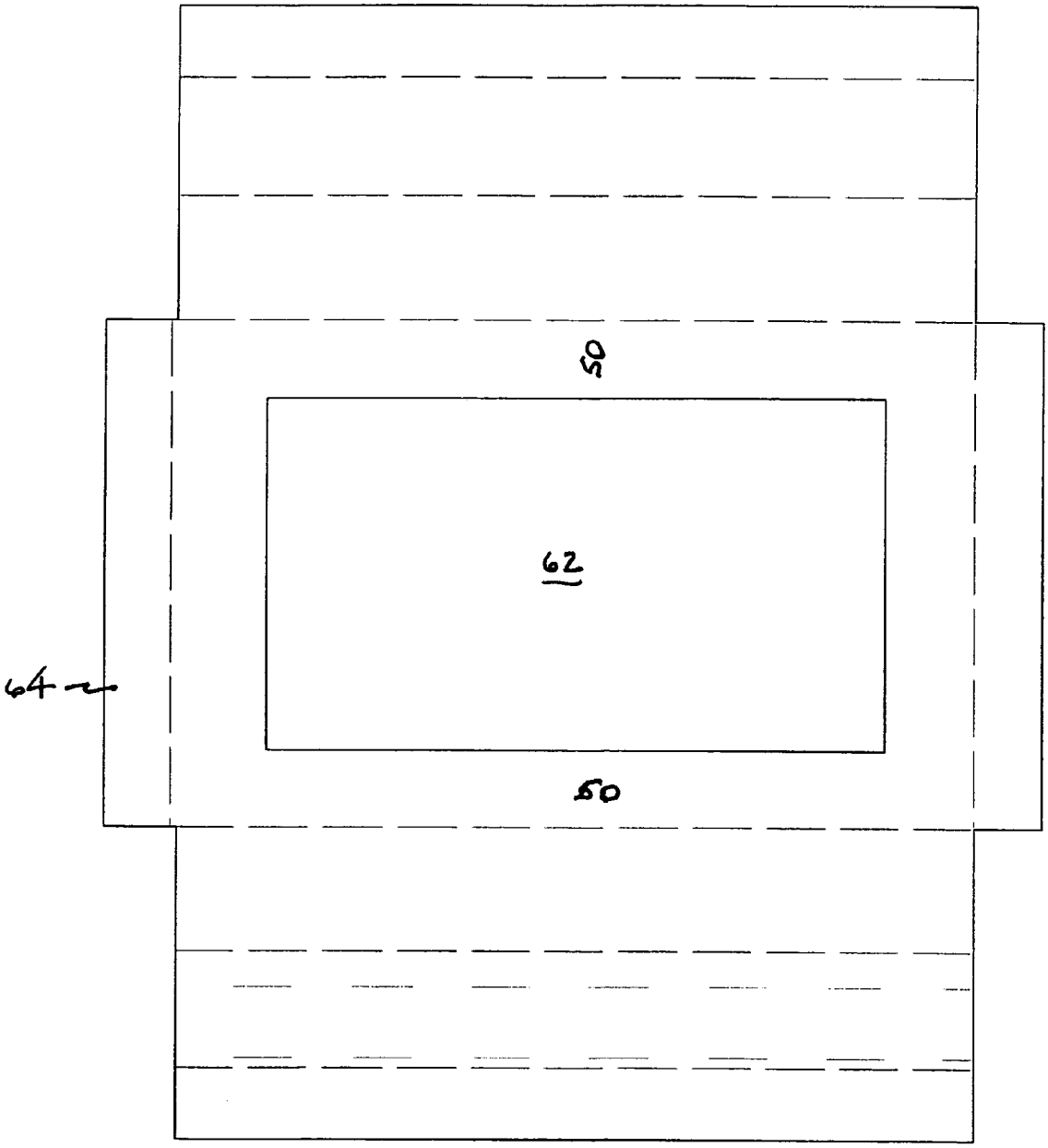
FIG. 8 is a layout for a "Megapost" end panel assembly according to a further aspect of this invention.
Figure 9:
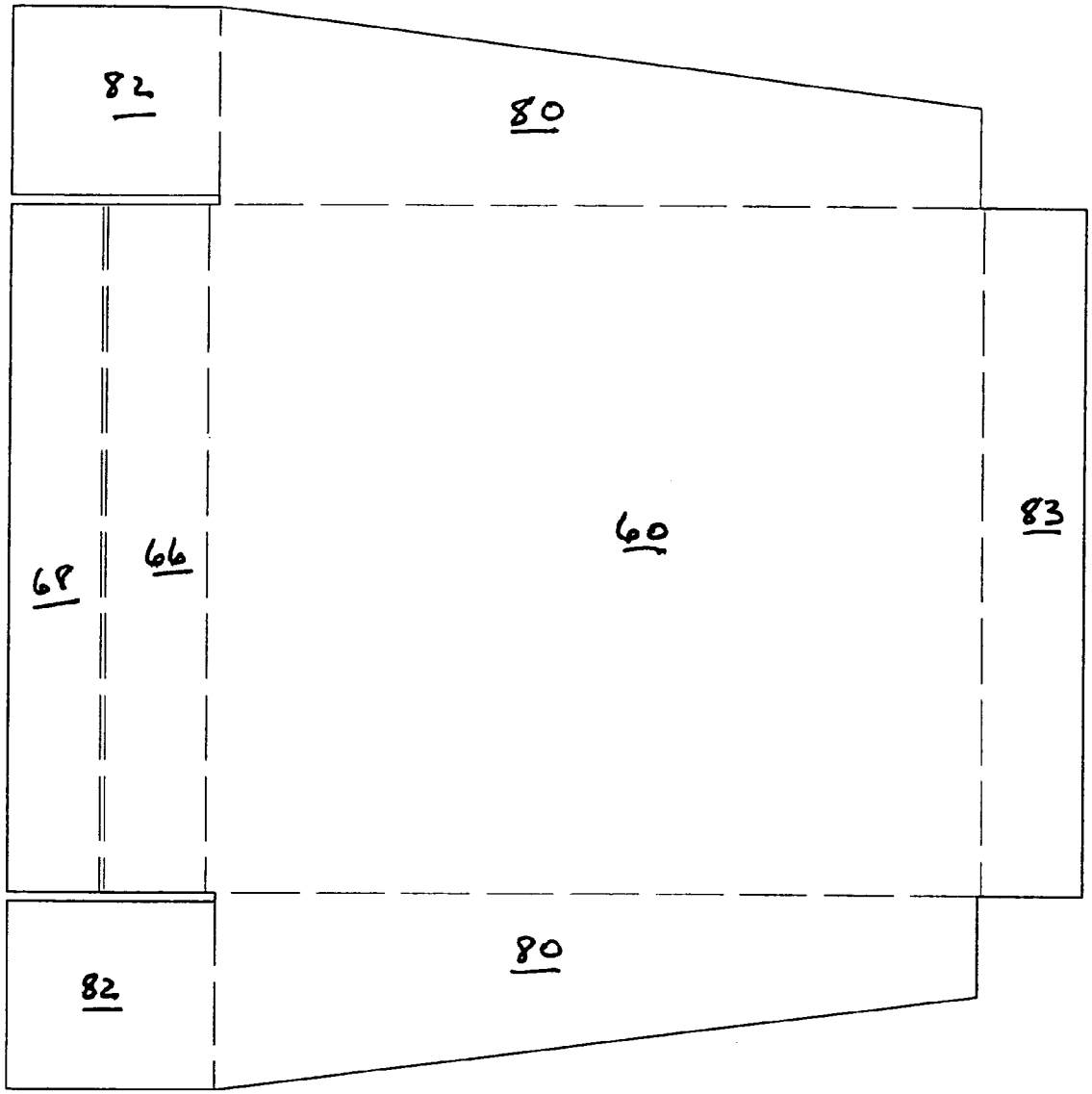
FIG. 9 is a layout for a top cover of the type shown in FIGS. 1, 2, 6 and 7.
Figure 10:
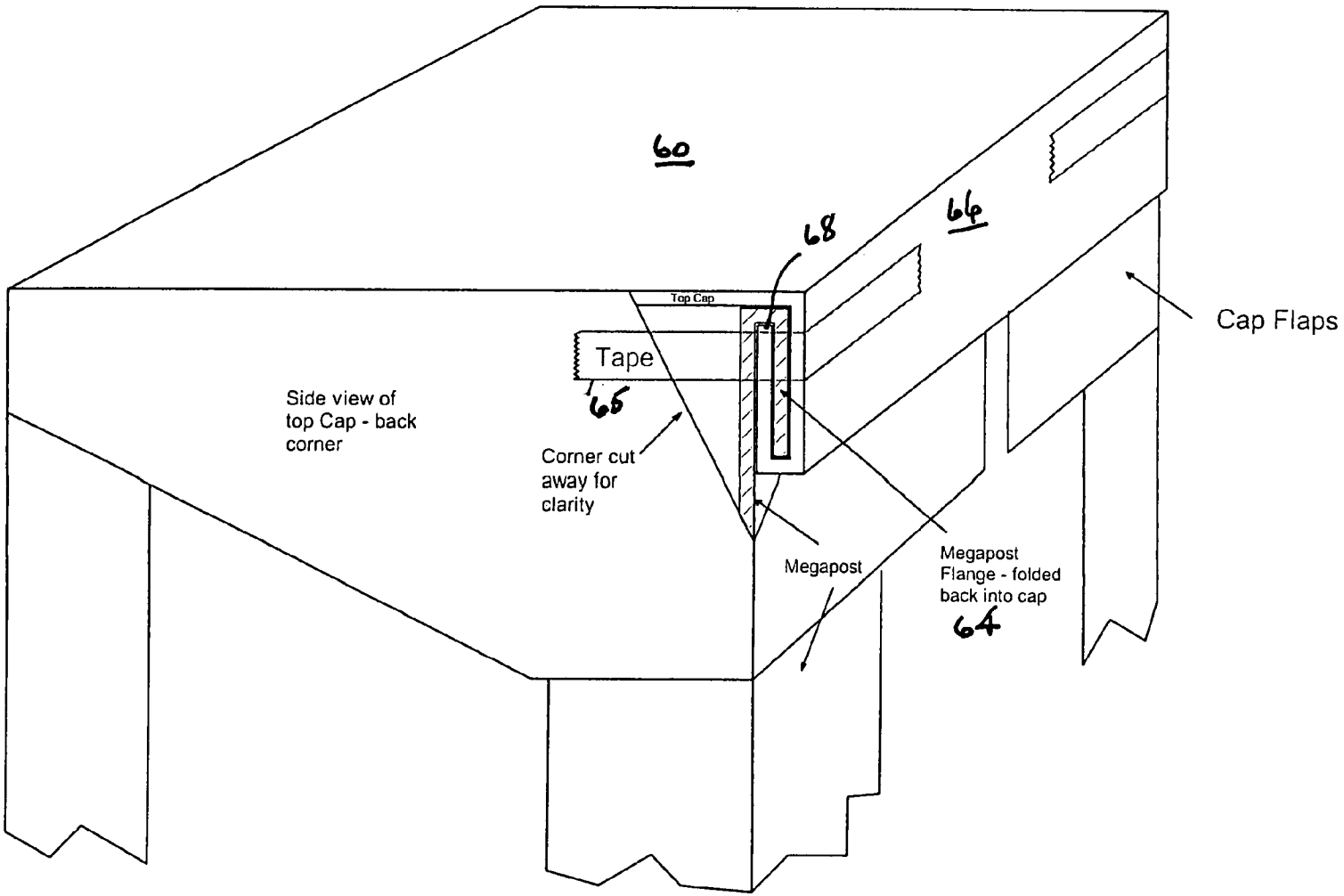
FIG. 10 is a detailed, partially cutaway, diagrammatic view of certain details of a top cover according to certain aspects of this invention; and FIGS, 11, 12 and 13 are layout drawings for some alternative base pads according to the present invention.

The cover 60 is also preferably reinforced. In FIGS. 9 and 10, details of top cover 60 as it would be implemented in connection with a "megapost" arrangement of FIGS. 6, 7 and 8 is shown. As shown in FIG. 8, a lifting support flange member 64 at the upper end of the "megapost" layout (see also FIG. 10—"Megapost flange") is provided to withstand the forces applied when the Basiloid system is employed to lift the appliance and its package. It can be seen in FIGS. 9 and 10 that the top cover 60 is provided with a mating set of flanges 66, 68 to interact with the flange 64 on the megapost. In this way, relatively heavy loads may be accommodated in the Bailoid system without breaking the cover 60 or any other portion of the package.

The cover 60 may be placed over the appliance on the base pad 30 either before or after the transparent film has been applied over the posts 50 and base pad 30. In the exemplary embodiment, the corners 62 of the cover 60 are aligned with the corners 32 of the base pad 30 when the cover 60 is disposed over the wrapped appliance and posts 50 so that the second end portions 54 of the angled corner posts 50 are disposed in corresponding corners 62 of the cover 60.

FIGS. 8, 9 and 10 illustrate the cover 60 having lifting flange members 66, 68 disposed across at least one side thereof. The lifting flange members 66, 68 are engagable by a Basiloid blade to permit lifting and handling of the packaged appliance when the cover 60 is fastened to the package assembly. In embodiments where the cover 60 is a corrugated paperboard material, the corrugation direction is preferably arranged transversely to the lifting flange member 66 for strength.

FIGS. 2, 7 and 10 also illustrate the cover 60 may be taped for added strength in holding the desired configuration in place.

In the exemplary embodiments, the cover 60 is formed of a corrugated paperboard or other similarly workable sheet stock. The cover 60 comprises generally a cover portion having a central area (rectangular) and side portions 80 formed by folding portions of the sheet stock and fastening flap portions 82, 83.

Configured in this manner, it should be apparent that the packaging assembly may be lifted and handled upon engagement of the lifting flange member 66 by a Basiloid blade. The packaging assembly may also be lifted and handled by a clamp truck or, if necessary, by a fork lift.

The foregoing written description of the invention is intended to enable a person of ordinary skill in this art to make and use what is considered presently to be the best mode of the invention. However, those of ordinary skill will understand and appreciate the existence of various combinations and equivalents of the exemplary elements and embodiments described above which are intended to be covered by the following claims.

What is claimed is:

1. A packaging assembly useable for erecting, packaging and displaying an appliance, comprising:

a base pad disposable under an appliance to be packaged, said base pad having extended, upwardly folding flanges on at least two sides thereof;

a plurality of rigid posts each having a first end portion disposed on said base pad, each post being disposed alongside an upright corner of the appliance to be packaged and having an opposing second end portion;

each of said first end portions of said posts being fixedly attached to an adjacent one of said upwardly folding flanges and to said base pad at a corner thereof; and each of said first end portions of said posts is disposed between adjacent one of said folding flanges of the base pad and one of a plurality of cutaway segments at the corner of the base pad;

a cover disposed over the second end portion of the plurality of posts, the cover having a lifting flange member having a discrete reinforcing member arranged across at least one side of the cover.

2. The packaging assembly of claim 1, wherein the posts are angled corner posts, the base pad and cover each having a plurality of corners, the first and second end portions of the angled corner posts are disposed in corresponding corners of the base pad and cover.

3. The packaging assembly of claim 2, wherein the base pad and cover are each formed of a corrugated paperboard material and said base pad is reinforced with tabs extending from and folded under said base pad.

4. The packaging assembly of claim 2, wherein the corner posts are fastened at their respective ends to said base pad and said cover.

5. The packaging assembly of claim 1, wherein said cover is a corrugated paperboard material, and a lifting flange member of said cover is defined by a side portion of said cover folded over a portion of a reinforcing member extending from an inner portion of said cover.

6. A method of packaging an appliance, comprising:

placing the appliance on a reinforced base pad having a plurality of upwardly extending flanges;

positioning a plurality of rigid angled corner posts alongside said upwardly extending flanges in a position corresponding to alongside the corners of an appliance to be packaged; and fixedly attached first end portions of said corner posts to an adjacent one of said upwardly folding flanges and to said base pad; each of said first end portions of said posts is disposed between adjacent one of said folding flanges of the base pad and one of a plurality of cut away segments at the corner of the base pad;

disposing a first end portion of each post between said base pad and said flanges;

placing a reinforced cover over a second end portion of each post so as to enclose an appliance resting on said base pad, said cover having a lifting flange member with a discrete reinforcing member, the lifting flange member and the discrete reinforcing member thereof disposed across a side of the cover.

7. The method of claim 6 further comprising:

disposing a transparent bag over the appliance, posts, and at least a portion of the base pad, and heat shrinking the transparent bag to form a transparent film.

* * * * *